United States Patent [19]

Einhorn

[11] 4,010,697

[45] Mar. 8, 1977

[54] SHELF BRACKET ASSEMBLY AND BRACKET FOR SAID ASSEMBLY

[75] Inventor: Ruediger Einhorn, Katonah, N.Y.

[73] Assignee: Coats & Clark, Inc., Stamford, Conn.

[22] Filed: Jan. 23, 1976

[21] Appl. No.: 651,951

[52] U.S. Cl. ..... 108/93; 108/102; 211/153; 248/220.2; 248/245; 248/250

[51] Int. Cl.[2] ..... A47B 57/00

[58] Field of Search ..... 108/93, 102; 211/153; 248/222, 235, 241, 243–245, 247, 248, 250

[56] References Cited

UNITED STATES PATENTS

| | | | |
|---|---|---|---|
| 1,354,270 | 9/1920 | Wood | 248/250 |
| 1,702,937 | 2/1929 | Friedemann | 248/250 X |
| 2,266,274 | 12/1941 | Schroeder | 211/153 X |
| 3,368,784 | 2/1968 | Peterson | 248/245 |
| 3,415,477 | 12/1968 | Kondur | 248/245 X |

*Primary Examiner*—James C. Mitchell
*Attorney, Agent, or Firm*—Burgess Ryan and Wayne

[57] ABSTRACT

A shelf bracket assembly includes a bracket having a plate and a pair of flanges defining three orthogonal mounting surfaces. A clamp assembly is slidably mounted on one of the flanges, for clamping a shelf to the top of the other flange. A shelf extends between a pair of such brackets, and may be an expansible shelf.

19 Claims, 12 Drawing Figures

SHELF BRACKET ASSEMBLY AND BRACKET FOR SAID ASSEMBLY

This invention relates to mounting brackets and mounting bracket assemblies, and is particularly directed to the provision of a bracket assembly and elements thereof for mounting a shelf from any desired surface. The assembly includes clamps slidably mounted on the brackets, enabling the clamping of a shelf between a pair of such brackets. While the invention is particularly directed to the mounting of a shelf, it will be apparent that the assembly, as well as the components thereof, may be employed in other applications.

It is frequently desired to provide a shelf extending across a window, whereby plants or other objects may be displayed. On some occasions the shelf may be mounted by means of brackets at the sides of the window to surfaces perpendicular to the plane of the window, and on other occasions it may be necessary to mount the brackets for the shelf on surfaces at each side of the window and parallel to the plane of the window.

Shelf bracket assemblies employed in the past have generally been adapted only to one form of mounting, so that the user must determine which type of bracket can be employed in a given location, before purchasing the necessary hardware.

The present invention is directed to the provision of brackets for so mounting a shelf, wherein the brackets may be mounted to either type of mounting surface, and in fact may be universally employed for holding a shelf or the like.

When a shelf is mounted between a pair of brackets, the shelf must generally have a depth no greater than the length of the lower arms of the brackets, in order to avoid tipping of the shelf. While some brackets have employed flanges or clips for holding the shelves, so that deeper shelves may be employed, the holding means are generally adaptable only to shelves of one determined thickness.

According to a further feature of the invention, slidable clamp means are provided on the mounting brackets, so that the brackets may firmly hold shelves of any desired thickness, and of any desired depth, even though the depth is greater than the lower arm of the brackets.

Briefly stated, in accordance with the invention, a shelf mounting bracket is comprised of a plate defining one mounting surface, and having a pair of flanges extending from adjacent edges thereof in perpendicular planes, whereby the plate and flanges define three mutually orthogonal mounting surfaces. Mounting apertures are provided in the plate and flanges so that the bracket may be mounted in any desired position. The bracket may be provided with holes, so that it can serve alone as a mounting bracket, for example, of a single plant or other object.

A slot is provided in one of the flanges, and a clamp is slidably mounted in the slot, so that the clamp may be moved toward the other flange to hold a shelf thereon. The clamp is provided with a cam surface which can be rotated to engage the first flange, so that the clamp may be locked in position as desired.

While the clamp is particularly useful with the bracket of the invention, it may also advantageously be employed as a slidable clamp on other surfaces having slots for receiving the clamp.

In accordance with a still further feature of the invention, an extensible shelf is provided for use in combination with the shelf bracket of the invention. The extensible shelf is comprised of a pair of sheets of a material, such as aluminum or plastic, having shaped edges telescoped with one another, and having reinforcing ridges extending longitudinally thereon. In this arrangement, it is preferred that a gap be provided between the horizontal flange of the bracket and the vertical flange of the bracket, so that the reinforcing edge of the expansible shelf may extend into the gap of each bracket.

The shelf bracket assembly in accordance with the invention thereby enables the mounting of shelves at any vertical position on a window. The shelf employed in combination with the brackets may have any thickness, and the shelves may be instantly removed, for example, for cleaning, by flipping a release lever on the clamping devices. The brackets of the invention may alternatively be inverted, for use, for example, in the supporting of a wall shelf or for the support of planter poles, In order that the invention will be more clearly understood, it will now be disclosed in greater detail with reference to the accompanying drawings, wherein:

Figure 1:
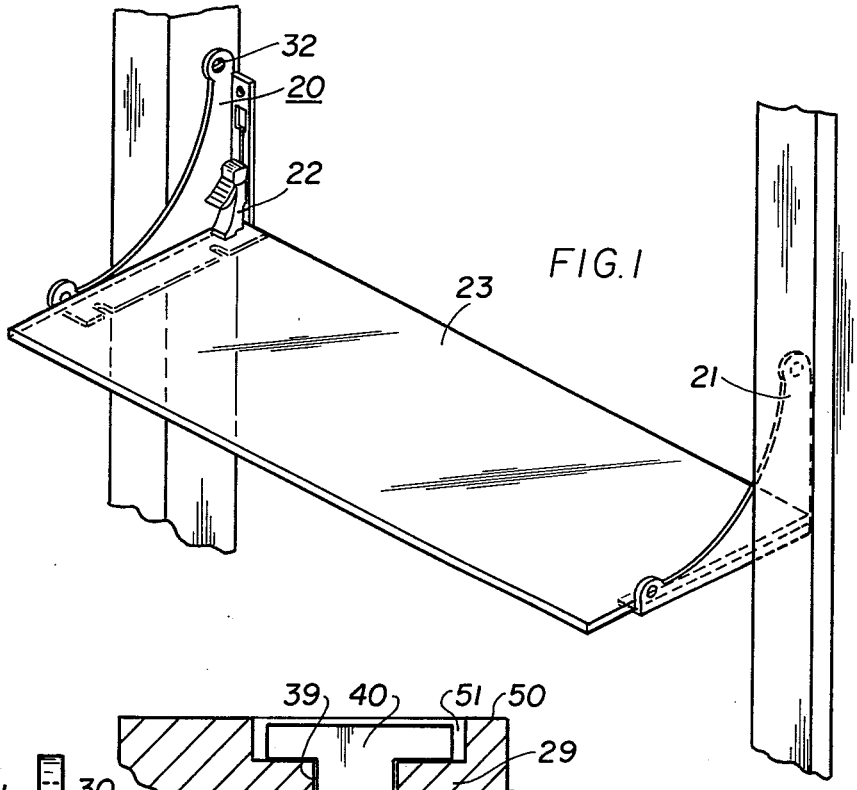
FIG. 1 is a perspective view of one application of a mounting bracket assembly in accordance with the invention.

Referring now to the drawings, FIG. 1 depicts the combined elements of shelf bracket assembly in accordance with one embodiment of the invention. The assembly is comprised of a left bracket 20, a right bracket 21, a pair of clamps 22, only one of which appears in FIG. 1, and a shelf 23. The bracket 20 and 21 are mirror images of one another, in order to enable their mounting on opposite sides of structures, for example, on opposite sides of a window frame. The clamps 22, one of which is provided for each of the brackets 20 and 21, are preferably identical in order to reduce their fabrication cost, since there is no need to design these components in a different manner for the two brackets. The clamps 22 are provided in order to enable clamping the shelf 23 between the brackets. The shelf 23 may be comprised of a sheet of glass plastic or the like, or even a board. An expansible shelf particularly adapted for use with the brackets 20, 21 may also be employed as will be discussed in the following paragraphs.

Figure 3:
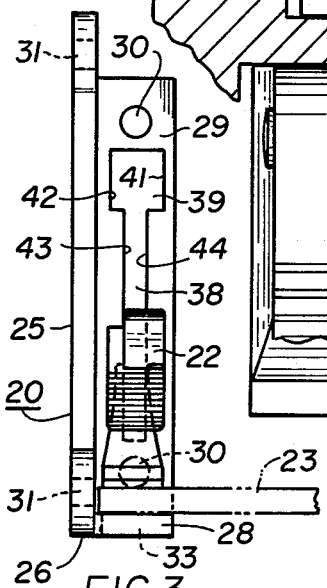
FIG. 3 is a front view of the bracket assembly of FIG. 1.
Figure 2:
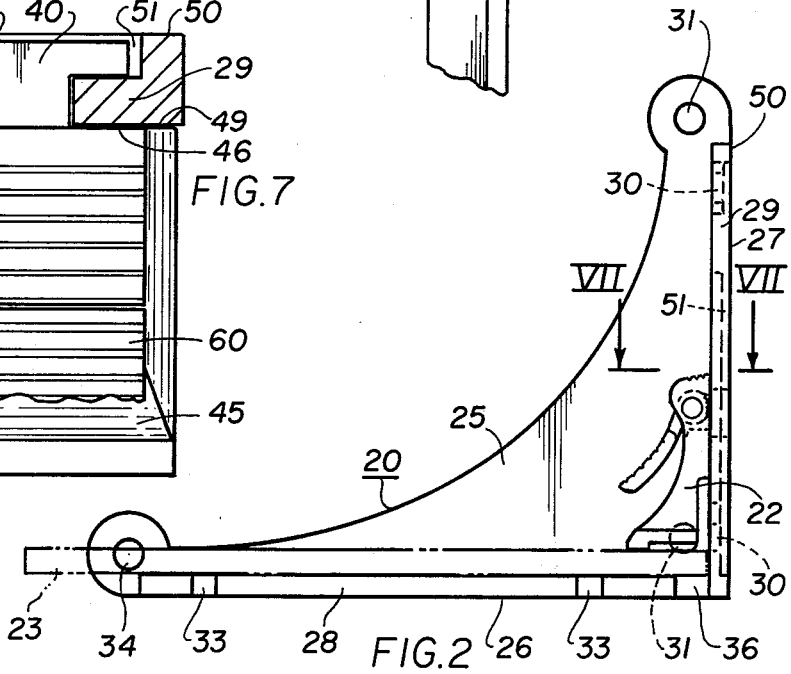
FIG. 2 is a side view of a bracket assembly in accordance with the invention.

With the elements of the invention thus oriented, their structural details will now be discussed. Referring now to FIGS. 2 and 3, the bracket 20 is comprised of a generally flat plate 25 having a pair of intersecting edges 26 and 27 which extend in planes at right angles to one another. A preferably rectangular flange 28 extends from the edge 26 in the plane thereof, and a preferably rectangular flange 29 extends from the edge 27 in the plane thereof, the two flanges 28 and 29 extending in the same direction from the plate 20, and normal thereto.

It will be apparent that the bracket 21 of FIG. 1 is formed in the same manner as the bracket 20, with the exception that the flanges of these two brackets extend in opposite directions relative to their respective plates.

In its most frequent use, the flange 28 serves as a support for the shelf 23, and the flange 29 cooperates with the clamp 22 in holding the shelf on the flange 28.

It is thus apparent that the plate 25, flange 28 and flange 29 lie substantially in mutually orthogonal planes which intersect at a common point. This feature enables the bracket to be mounted in any of a number of manners. For example, referring to FIGS. 2–4, a pair of spaced apart holes 30 are provided in the flange 29, in order to enable mounting of the bracket, for example, on a vertical casing surface parallel to the plane of a window. The holes 30 are of course preferably equidistant from the plane of the plate 25.

In order to mount the bracket on a vertical surface of a casing perpendicular to the plane of a window, a pair of spaced apart holes 31 are provided in the plate 25. The holes 31 are of course preferably equidistant from the plane of the flange 29, and relatively close thereto. FIG. 1 illustrates the mounting of a bracket in this manner employing conventional screws 32, only one of which appears in FIG. 1.

A pair of spaced apart slots 33 are provided in the flange 28. These slots extend from the edge of the flange 28 toward the plate 25, and can be employed for several different purposes. For example, if a wood shelf is used in combination with the brackets, it may be desirable to hold the shelf to the upper surface of the flange 28 by way of screws extending through the slots 33. It will be apparent, of course, that holes may be employed in place of the slots 33. In some applications it may be desirable to mount the bracket on a horizontal surface, in which case screws may be provided extending downwardly through the slots 28. As a further alternative, it is apparent that the bracket may be rotated, if desired, and employed with the flange 28 extending vertically, in which case the slots 33 may be employed as screw slots for holding the bracket to a vertical surface.

For further utility, an additional hole 34 may be provided in the plate 25. This hole 25 is spaced from the plane of the flange 28 a distance substantially equal to the distance between this plane and the closest hole 31, the hole 34 being disposed at the extremity of the plate 25 away from the plane of the flange 29. The hole 34 may be employed as a mounting hole, for example if the casing of a window is sufficiently wide, or it may be employed as a mounting hole when the bracket is rotated with the plane of the flange 28 vertically. Alternatively, the hole 34 may be employed as an eye for suspending an object. For example, the bracket 20 may be mounted on a window casing, a wall or the like, either in combination with a bracket 21 and shelf 23, or without such additional elements, so that the hole 34 is spaced from the wall and can be employed as an eye through which a cord or hook may extend to suspend an article.

Figure 4:
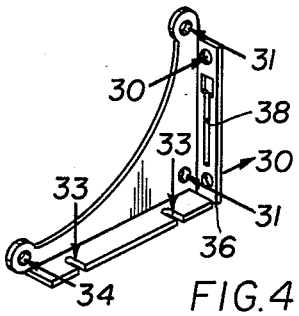
FIG. 4 is a simplified perspective illustration of the bracket of the assembly of FIGS. 2 and 3.

In the bracket illustrated in FIGS. 2–4, it is noted that the flange 29 extends to the junction of flange 29 with the plane of the flange 28, although the flange 28 does not extend to the plane of the flange 29, whereby a gap 36 is provided between the flanges 28 and 29. As will be shown in greater detail in the following paragraphs, this gap is particularly useful when some types of shelves are employed, whereby a flange or the like on the rear edge of the shelf may extend through the gap 36.

The configuration of the plate 25, aside from the above configurations, is a matter of choice. Thus, as illustrated in FIGS. 2–4, the plate 25 may be of minimal dimensions taken into consideration only the strength of the bracket and the desired ornamental features. The plate 25 may thus be considered to be a web or connecting plate for support between the two flanges. The hole 34 as discussed above, is in the outer extremity of one edge of the flange, and the upper hole 31, farthest away from the plane of the flange 28, may also be in an extremity of the plate 25, for example with the plate 25 having rounded edges in the vicinity of the mounted holes as extremity. The extremities of the plate 25 along the edges 26 and 27 may extend beyond the adjacent ends of the flanges 28 and 29.

The surfaces of the flanges 28 and 29 are preferably flat, with certain exceptions to be noted hereinafter, in order to provide flat mounting surfaces. The bracket 20 is preferably formed of metal, and may for example be die cast, although it will be apparent that other materials may be employed taking into consideration the necessary strength for the bracket.

Each bracket 20, 21 is provided with an elongated slot 38 in the flange 29, the slot 38 extending parallel to and spaced from the plane of the plate 25. The end 39 of the slot 38 away from the plane of the flange 28 is enlarged, for receiving the T-shaped sliding portion 40 of the clamp 22. Thus, the sides 41, 42 of the enlarged end 39 are spaced apart a distance greater than the width of the T-shaped portion 40 of the clamp, while the sides 43, 44 of the slot 38 itself are spaced apart a distance less than the width of the T-shaped end of the portion 40 of the clamp, to slidably receive this sliding portion 40.

Figure 6:
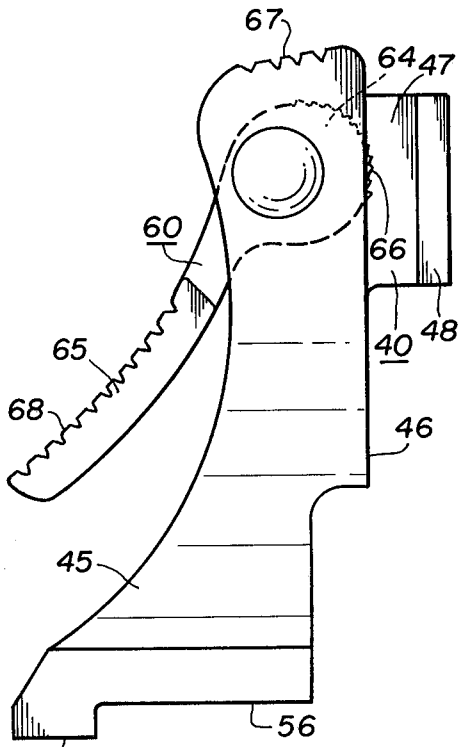
FIG. 6 is the other side view of the clamping assembly for the bracket assembly of FIG. 2.
Figure 5:
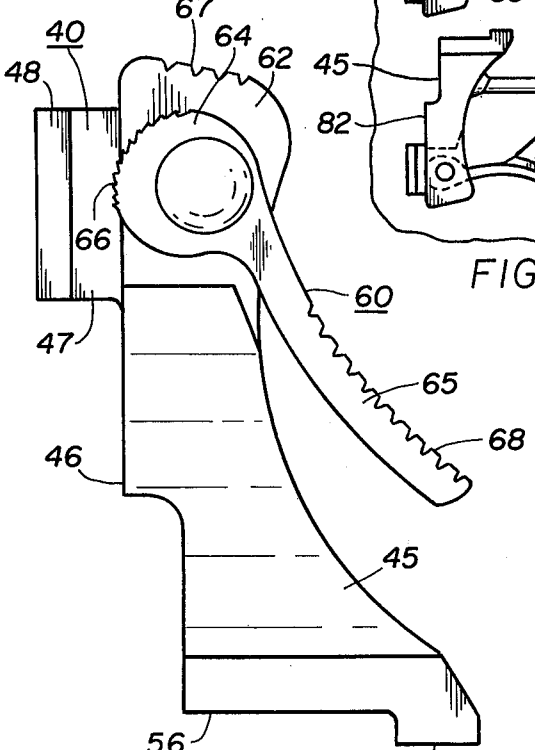
FIG. 5 is one side view of a clamping assembly for the bracket assembly of FIG. 2.

As illustrated in FIGS. 5 and 6, the clamp 22 has a body portion 45 with a substantially flat sliding surface 46 adapted to slidably engage the flat inner surface 49 of the flange 29. The T-shaped sliding portion 40 extends from the surface 46 of the clamp, with the leg 47 thereof joining the surface 46 and extending in a plane parallel to the plane of the plate 25. The leg 47 has a width to be slidably received in the slot 38. The arms 48 of the T-shaped portion 40 extend in a plane parallel to the surface 46. The sliding portion 40 has dimensions so that it may be fully inserted in the enlarged end 39 of the flange 29, and thence slid along the inner surface 47 of the flange 29 with the leg 47 thereof in the slot 38.

Figure 7:
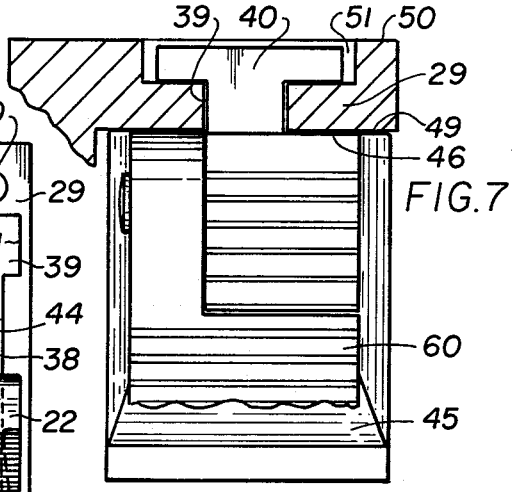
FIG. 7 is an enlarged partially cross sectional view of the assembly of FIG. 2, taken along the lines VII—VII.
Figure 8:
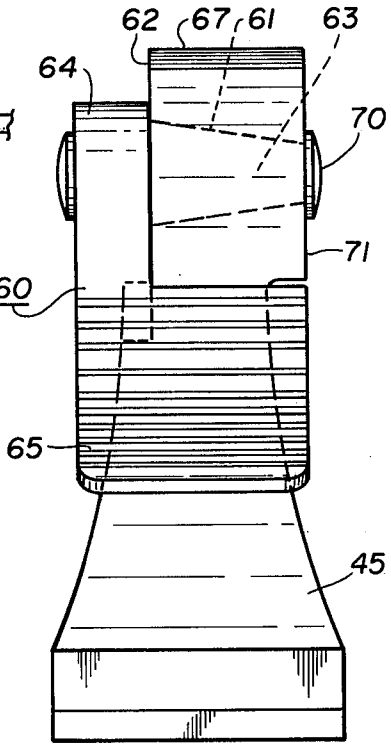
FIG. 8 is a front view of the clamping assembly of FIGS. 5 and 6.

The flat mounting surface 50 of the flange 29, opposite the inner surface 47, has an elongated recess 51, as illustrated in FIGS. 2 and 7, the recess 51 being in the region of the slot 38 and enlarged end 39 thereof, and having a width at least as great as the width of the arms 48 of the T-shaped portion 40 of the clamp. The depth of the recess 51 is also at least as great as the thickness of the arms 48, so that the clamp 22 may be slid in the bracket, even though the mounting surface 50 of the bracket is mounted on a wall. The body 45 of the clamp has a shelf engaging surface 55 spaced from the sliding portion 40 thereof, as appears in FIGS. 5, 6 and 8. For example, the shelf engaging portion 55 may constitute a projection from a surface 56 of the clamp extending generally normal to the surface 46. The surface 55 is spaced from the sliding surface 46, and is normal to the surface 46, and hence normal to the flange 28 of the bracket assembly, so that the clamp may be slid along the slot 38 to enable the top of the shelf to be engaged by the surface 55 of the clamp.

The body 45 of the clamp has a locking lever 60 pivoted thereto in the region of the sliding portion 40 thereof. For example, an aperture 61, preferably tapered, is provided extending through the body 45 adjacent to and spaced from the sliding portion 40, the axis of the aperture extending normal to the plane of the leg 47 of the sliding portion 40. The body 45 has a sliding surface 62 extending parallel to the plane of the leg 47, i.e., parallel to the plate 25 of the bracket, the plane of the surface 62 extending through the sliding portion 40. The locking lever 60 has a preferably tapered shaft 63 extending to the aperture 61, and a cam 64 slidably engaging the surface 62. A manually operable lever 65 extends from the cam 64, enabling rotation of the cam about the axis of the shaft 63. The cam 64 is eccentric, with a cam surface 66 thereof being spaced from the axis of the shaft 63 a greater distance than the sliding surface 46. As a result, when the clamp 22 is mounted on the bracket, the lever 65 may be manipulated to force the cam surface 65 against the inner surface of the flange 29, to thereby lock the clamp to the flange 29. The cam of the locking lever is positioned adjacent the sliding portion 40 of the clamp, so that the cam forces the inner surface of the arm 48 of the clamp against the bottom of the recess 51 of the flange.

The surface of the cam 66 may be provided with grooves, such as saw tooth grooves as illustrated, so that, upon depression of the lever 65, the grooves engage the inner surface of the flange 29, to tend to move the clamp 25 toward the shelf 23. This action serves to more firmly clamp the shelf to the bracket.

As illustrated in the drawings, the lever 65 extends generally downwardly, i.e., toward the shelf engaging surface 55, and away from the sliding surface 46.

Since the bracket 20, 25 is usually mounted with the clamp 22 above the shelf, for example as illustrated in FIG. 1, downward depression of the lever 65 clamps the cam 66 against the inner surface of the flange 29 and effects the downward movement of the clamp 22 as above noted, to more firmly clamp the shelf in place. The top 67 of the body 45, in this position, may be grooved, in order to readily enable the finger of a user to downwardly depress the body portion against the shelf, to thereby aid in the clamping of the shelf. In addition, the outer surface 68 of the lever may be grooved, as illustrated, or otherwise roughened, so that it can be more easily depressed by the finger of a user.

The surface of the cam 64 upwardly of the surface 66 is at a lesser distance from the axis of the cam than the surface 66, so that, upon lifting of the lever 65, the clamping force between the cam and the flange 29 is released, to thereby enable lifting of the cam, and removal of the shelf if desired.

As shown in FIGS. 5 and 6, the end of the surface 46 may be notched to assure that the clamp will not interfere with a mounting screw in the lower of the holes 30.

The lower portion of the lever 65, i.e., the portion away from the cam, may be widened as illustrated, in order to provide a larger surface for the finger of the user to engage.

Figure 9:
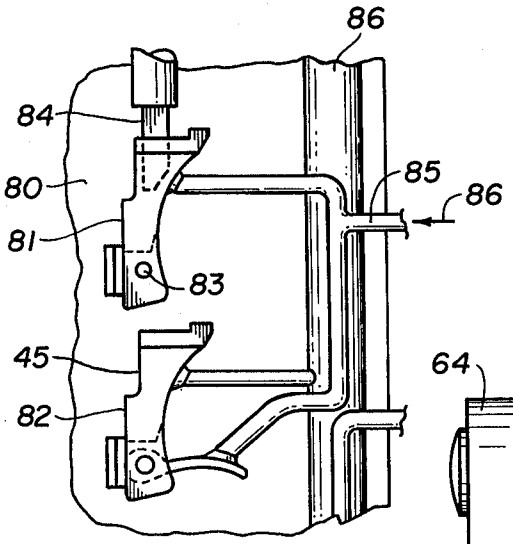
FIG. 9 is a simplified illustration of a die casting technique for forming the clamping assembly of FIGS. 5 and 6.

It is of course apparent that the end 70 of the shaft 63, away from the cam 64, is enlarged, the enlarged end 70 of the shaft engaging a flat portion 71 of the body 45 opposite the sliding surface 61 in order to prevent removal of the cam and lever from the body 45. While the clamp 22 has been described with a construction in which the shaft 63 extends from the cam 64, it will be apparent that, alternatively, the shaft may extend from the body 45, and through a corresponding hole in the cam, or that a separate shaft may be provided extending through both of these members. The illustrated embodiment of the invention, however, is preferred, since it enables the formation of the clamp 22 by a simple two step casting process as illustrated generally in FIG. 9. As shown in FIG. 9, one die 80 of a pair of movable dies is provided with one die cavity 81 in the shape of the body portion 45 of the clamp, and a second die cavity 82 in the shape of the combined body portion 45 and locking lever 60. In the formation of the clamp, a previously formed body portion 45 is inserted in the die cavity 82, a core rod 83 is inserted in the die cavity 81 to form the aperture 61, and, if desired, a further core rod 84 may be inserted in the die cavity 81 extending through the surface 56, so that the body portion 45 may be formed with a recess in this surface to minimize its weight. Molten die casting metal, such as Zamak 3 zinc die casting alloy, is then injected in a gate 85, as indicated by the arrow 86, the gate 85 extending around a transfer core rod 86 and thence to the cavity 81, and to the portion of the cavity 82 in which the locking lever is to be formed. As a consequence, a complete body portion 45 is formed in the cavity 81, and, employing the bearing surfaces of the previously formed body portion 45 as die surfaces, the locking lever 60 is formed in the die cavity 82. The core rods 83 and 84 are then removed, and the body portion 45 formed in the die cavity 82 is moved by means of the transfer core rod 86 to the die cavity 82, for further casting operations as above described. A two step die casting process of this type is disclosed, for example, in U.S. Pat. No. 2,818,494, Morin, and a clamp of a similar type is disclosed, for example, in my U.S. Pat. No. 3,911,516. As discussed above, it is preferred that the aperture and shaft of the clamp be tapered. This preference results from the fact that, when a tapered aperture and shaft are employed, it is relatively easy to free the pivotal joint. As discussed in U.S. Pat. No. 3,880,021, Hannes et al, the joint may be freed by upsetting the enlarged end of the shaft to provide a clearance between the elements.

The above described technique for forming the clamp 22 is readily adaptable to manufacture of this element by mass production die casting techniques, whereby the clamp may be provided with the desired ornamental configuration. It will be apparent, of course, that the invention is not limited to the formation of the clamp by this technique. It is to be noted that the bracket 20, 21 may also be advantageously formed by die casting techniques.

Figure 10:
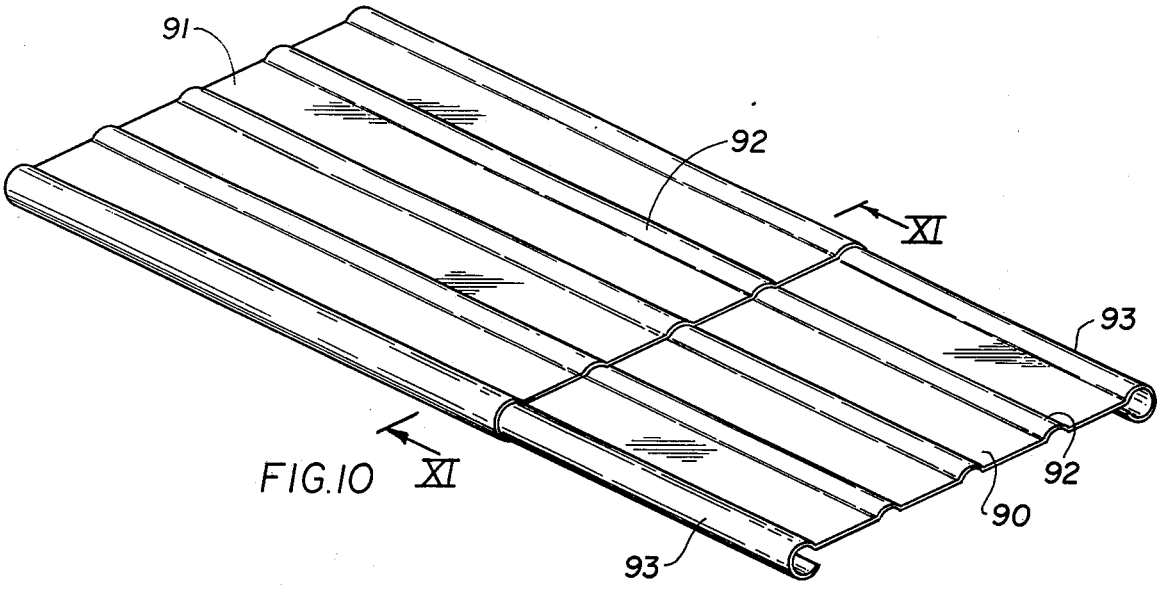
FIG. 10 is a perspective view of an expansible shelf which may be employed in combination with the shelf bracket assembly of the invention.
Figure 11:
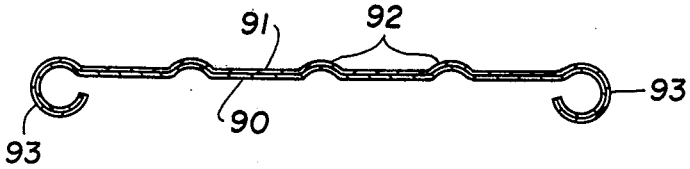
FIG. 11 is a cross sectional view of the shelf of FIG. 10, taken along the lines XI-XI.
Figure 12:
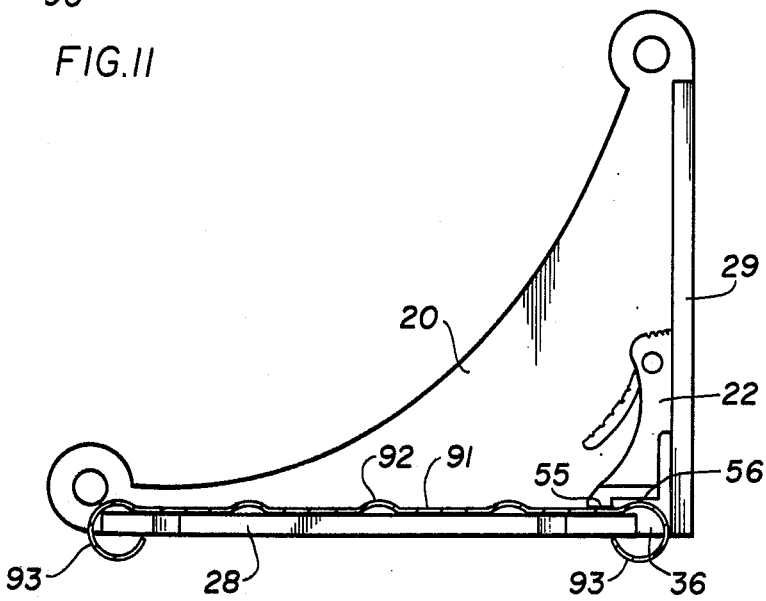
FIG. 12 is a side view of the bracket of FIG. 2, showing the shelf of FIG. 10 mounted thereon, in cross section.

While, as above discussed, the shelf 23 may conveniently be in the form of a glass, metal, wood or plastic sheet, a preferred extensible shelf is illustrated in FIGS. 10 and 11. The shelf is comprised of a pair of sheets 90 and 91, for example aluminum or plastic sheets. The sheets 90 and 91 have longitudinally extending ribs 92, and the longitudinal edges of these sheets are bent downwardly, for example to form split tubular edges 93 as shown. The sheets 90 and 91 are telescoped, for example with the sheet 90 being beneath the sheet 91, and the tubular edges of this sheet being within the tubular edges of sheet 91. Similarly, the ridges 92 of the lower sheet 90 engaged the concave undersides of the ridges of the upper sheet 91. The shelf illustrated in FIGS. 10 and 11 is thereby extensible. The shelf illustrated in FIGS. 10 and 11 is also particularly adapted for use with a bracket in accordance with the invention. Thus, as illustrated in FIG. 12, which is a plane view of the bracket 20 with the extensible shelf element 91 mounted thereon, the lower surface of the element 91 engages the upper surface of the flange 28, and the generally tubular edges of the sheet 91 extend around the longitudinal edges of the flange 28. Thus, the tubular edge 93 to the right of this figure extends through the gap 36 between the flange 28 and the flange 29. It is to be further noted that, in the arrangement of FIG. 12, since the projection on which the clamping surface 55 of the clamp 22 extends downwardly from the surface 56 of the clamp, the clamping surface 55 engages the sheet 91 inwardly of the rounded edge 93 thereof, so that the clamp 22 does not tend to flatten the rounded edge 93 of the sheet 91.

It will of course be apparent that the extensible shelf may have other forms, and, for example, the longitudinal edges thereof may be also shaped differently.

While the invention has been disclosed and described with reference to a limited number of embodiments, it will be apparent that variations and modifications may be made therein, and it is intended in the following claims to cover such variation and modification as follows within the true spirit and scope of the invention.

I claim:

1. A bracket comprising a plate, one side of which defines a first mounting surface, said plate having first and second adjacent edges which extend at right angles to one another, first and second flanges extending from said first and second edges respectively, in a direction away from said first mounting surface, said first and second flanges defining second and third mounting surfaces respectively extending to said first and second edges respectively, a pair of mounting apertures extending through at least one of said flanges, a mounting hole in said plate adjacent the junction of said first and second edges, said flanges extending given distances along said first and second edges respectively, with said first flange extending to said junction, said plate extending beyond said flanges along said first and second edges in the direction away from said junction, and a pair of first and second holes in said plate adjacent said first and second edges respectively, and beyond said first and second flanges, in the direction away from said junction.

2. The bracket of claim 1 wherein said second flange does not extend to said junction, whereby a gap is defined between said first and second flanges at said junction.

3. The bracket of claim 1 further comprising an elongated slot extending through one of said flanges parallel to and spaced from said plate, said slot having an enlarged end away from said junction, and a recess in said mounting surface of said one flange and extending along at least a portion of the sides of said slot.

4. A mounting bracket assembly comprising a bracket and a clamping member, said bracket having first and second mounting elements extending in perpendicular planes, a slot in said first mounting element, said slot extending normal to the plane of said second mounting element, said clamping member being slidably mounted on said first mounting element for movement toward and away from said second mounting element, said clamping member comprising guide means slidably extending through said slot for holding said clamping member against said first mounting member, and clamping means for clamping said clamping member to said first mounting element.

5. A mounting bracket assembly comprising a bracket having a first substantially flat member defining a first mounting surface on one side thereof and a sliding surface opposite said first mounting surface, a second member defining a second mounting surface perpendicular to said first mounting surface and extending on the sliding surface side of said first member, means rigidly holding said first and second members with respect to one another, and a clamp slidably mounted on said sliding surface for movement toward and away from said second mounting surface, said clamp comprising clamping means for clamping said clamp to said first member, said first member having a slot extending therein normal to the plane of said second mounting surface, said clamp having a projection slidably extending into said slot, said clamping means comprising rotatable cam means on said clamp positioned to engage said sliding surface, said cam means having an axis parallel to said mounting surfaces.

6. The mounting bracket assembly of claim 5 wherein said means rigidly holding said first and second members comprises plate means perpendicular to said first and second mounting surfaces, and said first and second members comprise flanges on said plate.

7. The mounting bracket assembly of claim 5 wherein said projection has a T-shaped cross section, with the leg thereof extending through said slot and the arms thereof engaging said first member opposite said sliding surface.

8. The mounting bracket assembly of claim 7 comprising a recess in said first mounting surface in the region of said slot, whereby said arms of said T-shaped projection engage the bottom of said recess.

9. The mounting bracket assembly of claim 5 wherein said slot has an enlarged end away from said second mounting surface for receiving said projection.

10. The mounting bracket assembly of claim 5 wherein said clamp has a sliding surface engaging said sliding surface of said first member, said projection slidably extending through said slot for holding said clamp slidably to said first member.

11. The mounting bracket assembly of claim 10 wherein the pivotal axis of said cam extends parallel to said first and second mounting surfaces.

12. The mounting bracket assembly of claim 11 wherein said cam is pivoted to said clamp adjacent said projection, and further comprising a lever affixed to said cam for rotating said cam, whereby movement of said lever toward said second mounting surface moves said cam surface into engagement with said sliding surface of said first member.

13. The mounting bracket assembly of claim 12 wherein said cam surface has saw-teeth extending axially thereacross.

14. The mounting bracket assembly of claim 10 wherein said clamp has a clamping surface extending therefrom toward said second mounting surface and spaced from said sliding surface.

15. A mounting bracket assembly comprising first and second brackets each having a first substantially flat member defining a first mounting surface on one side thereof and a sliding surface opposite said first mounting surface perpendicular to said first mounting surface and extending on the sliding surface side of said first member, each bracket further having means rigidly holding said first and second members with respect to one another, a shelf extending between said first and second brackets and resting on the second mounting surfaces of said brackets, a slot in each first member extending normal to said shelf, and a separate clamp slidably mounted on the sliding surface of each of said brackets for movement toward and away from the shelf on the respective second mounting surfaces, said clamps comprising a clamp body slidable on said sliding surface and having a guide extending through said slot for slidably holding said clamp body on said first member, and clamping cam means for clamping the respective clamps to the respective first members.

16. The mounting bracket assembly of claim 15 wherein said shelf is extensible.

17. The mounting bracket assembly of claim 16 wherein said shelf comprises first and second telescoped elements having substantially flat central surfaces and downwardly extending edges.

18. The mounting bracket assembly of claim 17 wherein said first and second members comprise flanges that are spaced apart to define a gap therebetween, a downwardly extending edge of each said shelf element extending through a gap of the respective bracket.

19. A slide clamp comprising a body having a flat sliding surface, a T-shaped projection extending from said sliding surface and having a leg extending in a plane perpendicular to said sliding surface and an arm away from said sliding surface and in a plane parallel to said sliding surface, a cam pivotally mounted to said body adjacent said sliding surface for rotation about an axis perpendicular to the plane of said leg, said cam having a cam surface rotatable to a position between the planes of said sliding surface and said arms of said projection, and means for rotating said cam.

* * * * *